US006276351B1

(12) United States Patent
Treadway

(10) Patent No.: US 6,276,351 B1
(45) Date of Patent: Aug. 21, 2001

(54) TAKE-DOWN ARCHERY BOW

(76) Inventor: Michael J. Treadway, 7795 Meadows Town Rd., Marshall, NC (US) 28753

( * ) Notice: Subject to any disclaimer, the term of this patent is extended or adjusted under 35 U.S.C. 154(b) by 0 days.

(21) Appl. No.: 09/561,153

(22) Filed: Apr. 28, 2000

(51) Int. Cl.[7] ..... F41B 5/00
(52) U.S. Cl. ..... 124/23.1
(58) Field of Search ..... 124/23.1, 25.6, 124/86, 88

(56) References Cited

U.S. PATENT DOCUMENTS

| | | | | |
|---|---|---|---|---|
| 1,853,294 | | 4/1932 | Barnhart | 124/23.1 |
| 2,228,823 | | 1/1941 | Helm | 124/23.1 |
| 2,457,793 | * | 12/1948 | Bear | 124/23.1 |
| 2,813,818 | * | 11/1957 | Pearson | 124/23.1 X |
| 3,156,230 | | 11/1964 | Groves | 124/23.1 |
| 3,415,240 | | 12/1968 | Bear | 124/23.1 |
| 3,502,063 | | 3/1970 | Bear | 124/23.1 |
| 3,612,028 | | 10/1971 | Karbo | 124/23.1 |
| 3,738,348 | | 6/1973 | Karbo | 124/23.1 |
| 3,814,075 | | 6/1974 | Hoyt | 124/23.1 |
| 3,921,598 | | 11/1975 | Helmick | 124/23.1 |
| 3,957,027 | | 5/1976 | Drake | 124/23.1 |
| 4,574,766 | | 3/1986 | Izuta | 124/23.1 |
| 4,674,468 | | 6/1987 | Izuta | 124/23.1 |
| 5,025,774 | | 6/1991 | Martin | 124/89 |
| 5,291,874 | | 3/1994 | Harrison | 124/23.1 |
| 5,570,675 | | 11/1996 | Treadway | 124/23.1 |

* cited by examiner

*Primary Examiner*—John A. Ricci
(74) *Attorney, Agent, or Firm*—Joseph T. Guy

(57) ABSTRACT

An improved take-down archery bow is provided which is easy to assemble and disassemble and which has minimal parts. The invention is a take-down archery bow which comprises a first limb and a second limb. The first limb comprises a first abutment surface, a first outer extent with a first string connection point at the first outer extent and a first plug. The second limb comprises a second abutment surface, a second outer extent with a second string connection point at the second outer extent, and a second plug. A keeper is provided which comprises an elongated face shaft, a first leg shaft attached to one end of the elongated face shaft and a second leg shaft attached to the elongated face shaft opposite to the first leg shaft. The first leg shaft is received by the first plug and the second leg shaft is received by the second plug to prohibit separation of the two limbs.

17 Claims, 2 Drawing Sheets

TAKE-DOWN ARCHERY BOW

BACKGROUND

This invention relates to an archery bow which can be dissembled for storage and transport and reassembled for use. More specifically this invention relates to an archery bow which has an improved method for attaching the limbs which does not require threaded bolts, screws, etc. and yet still has the strength and rigidity necessary for safe use and accurate shooting.

Archery, as a sport, has spanned many generations and is still popular today. The use of archery equipment includes many sporting events such as target events wherein competitors attempt to place arrows in a small region of a target.

The necessity to transport archery equipment is paramount to full enjoyment of the equipment. The length of a bow often makes it difficult to carry the bow in the trunk, or seat, of a vehicle. This has caused a long felt desire for an archery bow which can be disassembled without sacrificing the safety and accuracy of the bow.

There are many examples of two-piece and three-piece archery bows which can be disassembled and reassembled. Examples of three piece archery bows are exemplified in U.S. Pat. Nos. 4,674,468; 4,574,766; 3,957,027; 3,415,240; 3,921,598; 3,814,075 and 3,502,063. These all require two limbs to be attached to a central handle. The time required to assemble these archery bows decreases the time allotted for enjoyment and any slight difference in the mounting of the two limbs may decrease the accuracy of the archery bow. It is realized in the art that an archery bow designed for disassembly is best if the archery bow is approximately symmetrical with respect to the assembly joint. Two-piece construction is preferable to three-piece construction if frequent disassembly is desired.

Two-piece archery bows are exemplified in U.S. Pat. Nos. 5,570,675; 3,738,348; 3,612,018 and 3,156,230. U.S. Pat. No. 3,156,230 is an asymmetrical archery bow which is deficient due to decreased accuracy as described previously. U.S. Pat. No. 3,738,348 comprises stepped interior ends which must be perfectly machined to obtain a suitable fit between the two sections. Any wear in the stepped interior ends would cause the fit between sections to be less rigid which would lead to inaccuracy. U.S. Pat. No. 3,612,028 comprises a hinge which is undesirable since any wear in the hinge would result in movement of the two halves relative to each other which would decrease accuracy.

The two-piece design exemplified in U.S. Pat. No. 5,570,675 has received acclaim in the art due to rigidity of the joint and the accuracy achieved even after extended use. A disadvantage of the archery bow exemplified in U.S. Pat. No. 5,570,675 is the requirement of a bolt to maintain the two halves in a fixed position. One application of an archery bow is in hunting wild animals. This is typically done in the cold weather months and it is often difficult to insert and turn the threaded bolt with cold hands. Also, the problem associated with dropping, and losing, the threaded bolt is a bother to many archers.

While the availability of archery bows which can be easily assembled and disassembled has grown there is still a desire in the art for an archery bow which can be assembled and disassembled easily and without the necessity for threaded bolts. This desire must be met with safety in mind since an archery bow which fails at the joint can be lethal to the user.

SUMMARY

It is an object of the present invention to provide a take-down archery bow which is safe and has minimal parts.

It is another object of the present invention to provide a takedown archery bow which can be easily assembled and disassembled.

These and other features are provided in a take-down archery bow which comprises a first limb and a second limb. The first limb comprises a first abutment surface, a first outer extent, with a first string connection point at the first outer extent, and a first plug. The second limb comprises a second abutment surface, a second outer extent with a second string connection point at the second outer extent, and a second plug. A keeper is provided which comprises an elongated face shaft, a first leg shaft attached to one end of the elongated face shaft and a second leg shaft attached to the elongated face shaft opposite to the first leg shaft. The first leg shaft is received by the first plug and the second leg shaft is received by the second plug to prohibit separation of the two limbs.

A preferred embodiment is provided in a take-down archery bow comprising a first limb and a second limb. The first limb comprises a first abutment surface and a first outer extent, with a first string connection point at the first outer extent, and a first bore parallel to the first abutment surface. The second limb comprises a second abutment surface and a second outer extent, with a second string connection point at said second outer extent, and a second bore parallel to the second abutment surface. A keeper is provided which comprises an elongated face shaft, a first leg shaft perpendicular to the elongated face shaft and attached to one end of said elongated face shaft, and a second leg shaft parallel to the first leg shaft attached to the elongated face shaft opposite to the first leg shaft. The first leg shaft is received by the first bore and the second leg shaft is received by the second bore to prohibit separation of the first limb and the second limb.

Yet another preferred embodiment is provided in a take-down archery bow comprising a first limb and a second limb. The first limb comprises a first abutment surface and a first outer extent with a first string connection point, a first bore parallel to the first abutment surface and a first recess. The second limb comprises a second abutment surface and a second outer extent with a second string connection point at the second outer extent, and a second bore parallel to the second abutment surface. A keeper is provided which comprises an elongated face shaft, a first leg shaft attached to one end of the elongated face shaft perpendicular to the elongated face shaft, and a second leg shaft parallel to the first leg shaft and attached to the elongated face shaft opposite to the first leg shaft. When the first leg shaft is received by the first bore and the second leg shaft is received by the second bore the first abutment surface of the first limb and the second abutment surface of the second limb can not separate. The first recess and second recess form a channel and the elongated face shaft is received within the channel.

DETAILED DESCRIPTION

The invention will be described in reference to the figures wherein similar elements are numbered accordingly.

Figure 1:
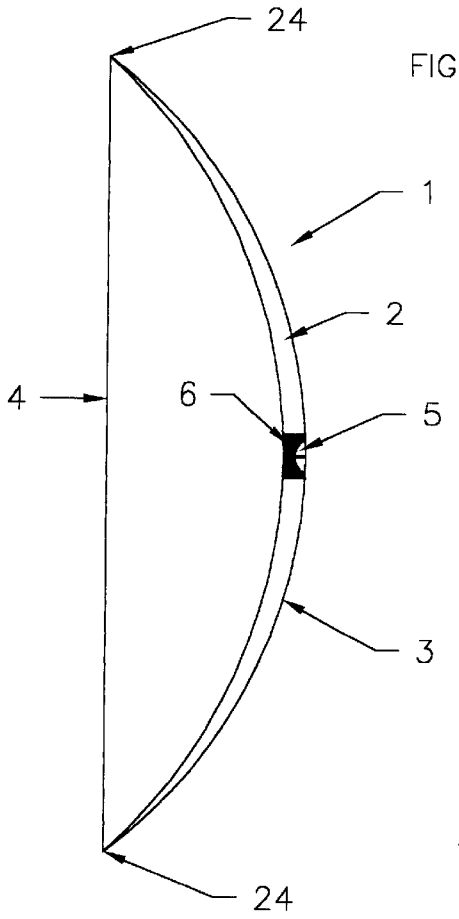
FIG. 1 illustrates a take-down archery bow with a grip shown in partial cutaway view illustrating the preferred location of a joint.

FIG. 1 shows a take-down archery bow generally represented at 1. The take-down archery bow comprises an upper limb, 2, and lower limb, 3, which meet at a joint generally represented at 5. A string, 4, connects the outer extent of the upper limb to the outer extent of the lower limb at string connection points, 24, as known in the art. It is particularly preferred that the joint, 5, be covered by a grip, 6. In FIG. 1 the grip, 6, is shown in partial cutaway view. As a matter of convention, the side of the archery bow closest to the string is the belly and the side furthest from the string is the back.

Figure 2:
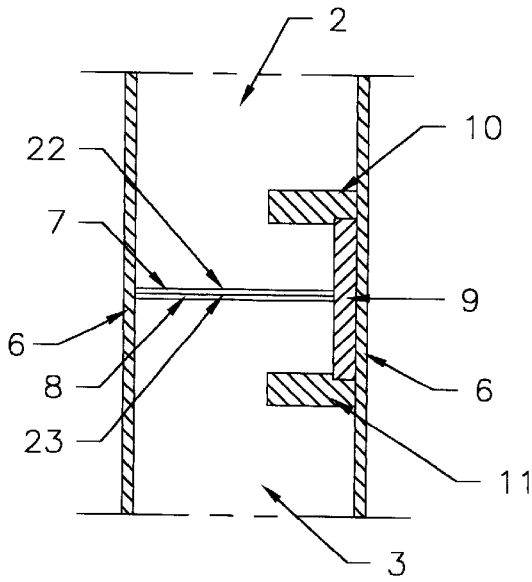
FIG. 2 is a detailed view illustrating an embodiment of the joint of the invention.

FIG. 2 illustrates the joint of the present invention. Attached to the abutment surface, 22, of the upper limb, 2, is an optional, but preferred, upper spacer, 7. Similarly, attached to the abutment surface, 23, of the lower limb, 3, is an optional, but preferred, lower spacer, 8. Each spacer is preferably a metal or metal alloy which is attached to the limb by an adhesive. The spacer is preferably rigid to avoid any deformation of the spacer during use of the archery bow. A "square U" shaped keeper, 9, is slidably received within a pair of plugs represented by an upper plug, 10 and a lower plug, 11. The upper plug and lower plug are secured to the upper limb and lower limb, respectively, by an adhesive, a set screw, or combination thereof. The keeper is on the back side of the archery bow such that when the string is pulled the strain is in the direction of elongating the keeper. The grip, 6, is a tubular stretchable material which covers the joint and keeper, 9. The grip improves the visual appeal of the archery bow by obscuring the joint and the grip inhibits the keeper from being removed. To remove the keeper the grip is rolled or slid in one direction to uncover the keeper and the keeper is withdrawn. Prior to removal of the keeper it is to be understood that the string is removed from the archery bow.

Figure 3:
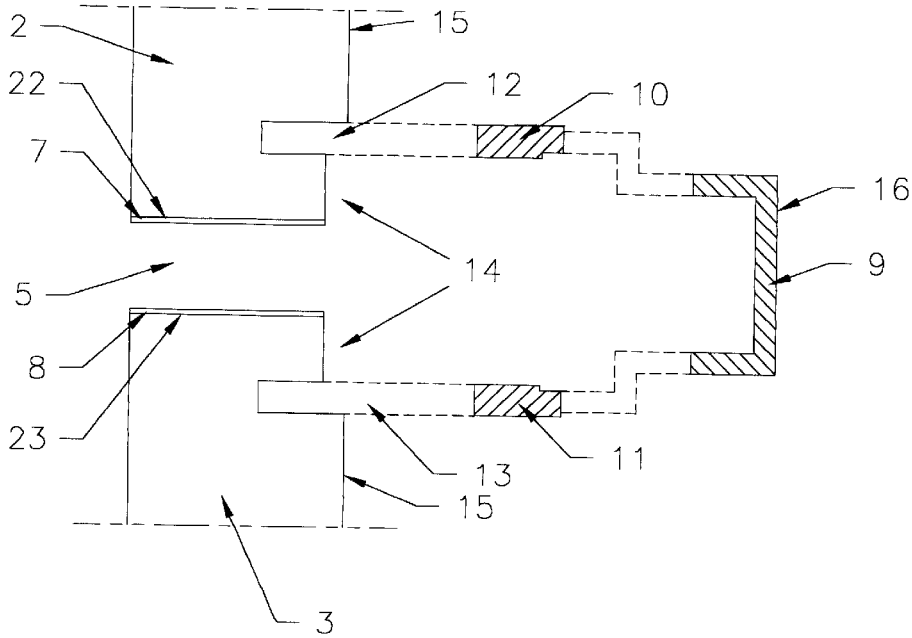
FIG. 3 is an exploded view illustrating an embodiment of the joint of the invention.

FIG. 3 provides an exploded view of an embodiment of the present invention. The upper plug, 10, is received and secured in an upper bore, 12, which is preferably parallel to the abutment surface, 22. The lower plug, 11, is received and secured in a lower bore, 13, which is preferably parallel to the abutment surface, 23. Both the upper limb, 2, and lower limb, 3, comprise a recess, 14, which forms a channel between the bores such that the back face of the archery bow, 15, and the outer face, 16, of the keeper form a surface with minimal steps between components. It is preferred that a user cannot distinguish the difference between the back face and outer face through the grip which is shown in FIG. 2.

Figure 4:
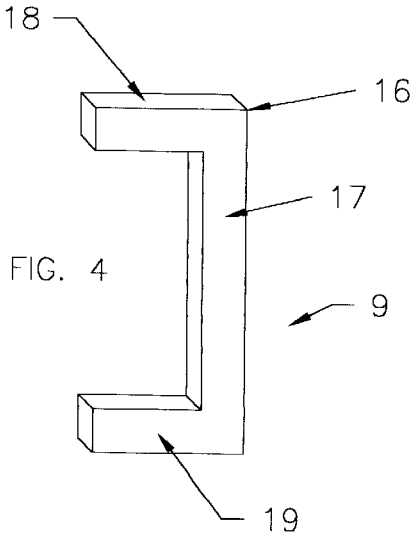
FIG. 4 is a detailed view illustrating a preferred keeper.

FIG. 4 provides a detailed view of a preferred keeper of the present invention. The keeper, generally represented at 9, comprises a face shaft, 17, and a pair of leg shafts, 18 and 19. The leg shafts are parallel to each other and perpendicular to the face shaft. It is preferred that the face shaft of the keeper has rectangular cross-section. It is preferred that the leg shafts have a rectangular cross-section. In a particularly preferred embodiment the keeper is a single piece of metal since this insures that the strength is not compromised. The keeper can be manufactured from many materials with stainless steel being most preferred due to price and strength. The length of the face shaft of the keeper is chosen to be long enough to provide sufficient material in the limbs for strength while not being so long as to add extra weight to the archery bow. The preferred keeper has a face shaft which is at least 2 inches long and no more than 6 inches long. More preferred is a keeper with a face shaft of at least 2.5 inches long and no more than 4 inches long. Approximately 3.25 inches has proven to be a preferred length for the face shaft of the keeper. The two leg shafts are preferably identical to avoid the keeper from having a specific orientation. The length of the leg shafts are preferably at least 0.5 inches long to no more than 2.5 inches long. A leg shaft of approximately 1.3125 inches has proven to be a preferred length. The shape of the keeper may be round, semicircular, triangular, rectangular, pentagonal, hexagonal or other shapes as known in the art. It is preferred that the outer face be planar or that it be formed to be continuous with the back of the archery bow. The keeper is preferably rectangular with the face shaft and leg shafts preferably having the same cross-sectional size and shape. Preferably the keeper has a rectangular cross-section. More preferred is a keeper with a rectangular cross-section with the rectangle being at least 0.1 inches on a side to no more than 0.75 inches on a side. Even more preferably the keeper has a rectangular cross-section with the rectangle being at least 0.25 inches on a side to no more than 0.375 inches on a side. Most preferably, the keeper has a square cross-section.

Figure 5:
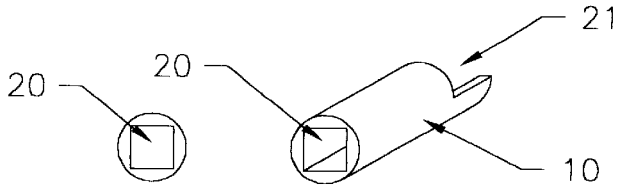
FIG. 5 is a detailed view illustrating a preferred plug.

FIG. 5 provides a detailed view of a preferred plug. The plug, generally represented at 10, is preferably round on the exterior with a rectangular bore, 20, which receives the leg shaft of the keeper as described previously. An optional, but preferred, notch, 21, is provided to allow the keeper to fit snugly into the plug as illustrated in FIGS. 2 and 3.

What is claimed is:

1. A take-down archery bow comprising:

a first limb comprising:

a first abutment surface and a first outer extent with a first string connection point at said first outer extent; and a first plug;

a second limb comprising:

a second abutment surface and a second outer extent with a second string connection point at said second outer extent; and a second plug;

a keeper comprising an elongated face shaft and a first leg shaft attached to one end of said elongated face shaft and a second leg shaft attached to said elongated face shaft opposite to said first leg shaft; wherein said first leg shaft is received by said first plug and said second leg shaft is received by said second plug to prohibit separation of said first abutment surface of said first limb from said second abutment surface of said second limb.

2. The take-down archery bow of claim 1 further comprising a spacer attached to said first abutment surface.

3. The take-down archery bow of claim 1 further comprising a grip covering said keeper.

4. The take-down archery bow of claim 1 wherein said first limb and said second limb comprise a recess for receiving said elongated face shaft of said keeper.

5. The take-down archery bow of claim 1 wherein said face shaft is at least 2 inches long and no more than 6 inches long.

6. The take-down archery bow of claim 1 wherein said first leg shaft is at least 0.5 inches long to no more than 2.5 inches long.

7. The take-down archery bow of claim 1 wherein said face shaft has a rectangular cross-section.

8. The take-down archery bow of claim 7 wherein said face shaft has a square cross-section.

9. The take-down archery bow of claim 7 wherein said face shaft, said first leg shaft and said second leg shaft have the same cross-section.

10. The take down archery bow of claim 7 wherein said plug comprises a rectangular bore.

11. A take-down archery bow comprising:

a first limb comprising:

a first abutment surface and a first outer extent with a first string connection point at said first outer extent; and a first bore parallel to said first abutment surface;

a second limb comprising:

a second abutment surface and a second outer extent with a second string connection point at said second outer extent; and a second bore parallel to said second abutment surface;

a keeper comprising an elongated face shaft;

a first leg shaft perpendicular to said elongated face shaft and attached to one end of said elongated face shaft;

a second leg shaft parallel to said first leg shaft attached to said elongated face shaft opposite to said first leg shaft; wherein said first leg shaft is received by said first bore and said second leg shaft is received by said second bore to prohibit separation of said first limb and said second limb; and wherein said first bore further comprises a plug.

12. The take-down archery bow of claim 11 wherein said second bore further comprises a plug.

13. The take-down archery bow of claim 11 further comprising a spacer attached to said first abutment surface.

14. The take-down archery bow of claim 11 further comprising a grip.

15. The take-down archery bow of claim 11 wherein said first limb and said second limb both comprise a recess for receiving said elongated face shaft of said keeper.

16. A take-down archery bow comprising:

a first limb comprising:

a first abutment surface and a first outer extent with a first string connection point at said first outer extent; and a first bore parallel to said first abutment surface; and a first recess;

a second limb comprising:

a second abutment surface and a second outer extent with a second string connection point at said second outer extent; and a second bore parallel to said second abutment surface; and a second recess;

a keeper comprising an elongated face shaft; and a first leg shaft attached to one end of said elongated face shaft perpendicular to said elongated face shaft;

a second leg shaft parallel to said first leg shaft attached to said elongated face shaft opposite to said first leg shaft; wherein when said first leg shaft is received by said first bore and said second leg shaft is received by said second bore such that said first abutment surface of said first limb and said second abutment surface of said second limb can not separate; and said first recess and said second recess form a channel and said elongated face shaft is received within said channel.

17. The take-down archery bow of claim 16 further comprising a grip covering said keeper.

* * * * *